United States Patent [19]

Sawada

[11] 4,077,208

[45] Mar. 7, 1978

[54] SECONDARY AIR SUPPLY CONTROL DEVICE

[75] Inventor: Hiraki Sawada, Seki, Japan

[73] Assignee: Nissan Motor Company, Limited, Japan

[21] Appl. No.: 707,690

[22] Filed: Jul. 22, 1976

Related U.S. Application Data

[63] Continuation of Ser. No. 502,432, Sep. 3, 1974, abandoned.

[30] Foreign Application Priority Data

Sep. 4, 1973 Japan ..... 48-99629

[51] Int. Cl.[2] ..... F02B 75/10; F01N 3/10

[52] U.S. Cl. ..... 60/277; 60/290; 60/294; 137/115; 417/278; 417/302

[58] Field of Search ..... 60/289, 290, 277, 294; 137/115; 417/278, 302

[56] References Cited

U.S. PATENT DOCUMENTS

| | | | |
|---|---|---|---|
| 2,263,318 | 11/1941 | Tifft | 60/294 |
| 2,406,973 | 9/1946 | Trisler | 417/278 |
| 2,407,139 | 9/1946 | Clothier | 417/302 |
| 3,017,922 | 1/1962 | Peterson | 137/115 |
| 3,360,927 | 1/1968 | Cornelius | 60/289 |
| 3,430,437 | 3/1969 | Saussele | 60/290 |
| 3,748,855 | 7/1973 | Day | 60/290 |
| 3,805,522 | 4/1974 | Sheppard | 60/277 |
| 3,826,089 | 7/1974 | Nakajima | 60/290 |

*Primary Examiner*—Douglas Hart
*Attorney, Agent, or Firm*—Balogh, Osann, Kramer, Dvorak, Genova & Traub

[57] ABSTRACT

A valve regulates the pressure of secondary air discharged from a pump to a constant value. A second valve then meters the flow in accordance with the amount of air taken into the engine.

9 Claims, 2 Drawing Figures

SECONDARY AIR SUPPLY CONTROL DEVICE

This is a continuation of application Ser. No. 502,432, filed Sept. 3, 1974, now abandoned.

The present invention relates generally to an exhaust gas cleaning system for an internal combustion engine and particularly to an improvement in a secondary air supply control device for such an exhaust gas cleaning system.

As is well known in the art, an exhaust gas purifying system for an engine is usually supplied with secondary air for oxidation of engine exhaust gases by a pump driven from the engine. In a conventional secondary air supply control device, the flow of secondary air supplied into engine exhaust gases has been controlled or metered by a flow control valve which is controlled by the intake manifold vacuum, pump discharge pressure or the like. However, the intake manifold vacuum is not necessarily varied in accordance with the flow of intake air drawn into the engine. The pump discharge pressure greatly varies with the engine speed. Thus, the amount of supplied secondary air has been undesirably insufficient or excessive relative to air taken into the engine. As a result, harmful components in engine exhaust gases have been not efficiently oxidized or detoxicated.

It is, therefore, an object of the invention to provide a secondary air supply control device which will control or meter the flow of secondary air supplied to engine exhaust gases to a desired ratio with respect to air drawn into the engine.

Figure 1:
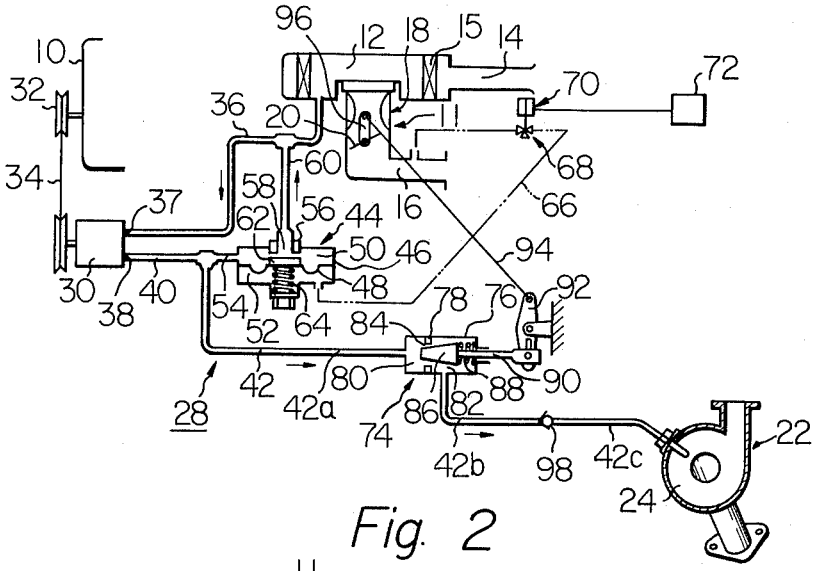
Figure 2:
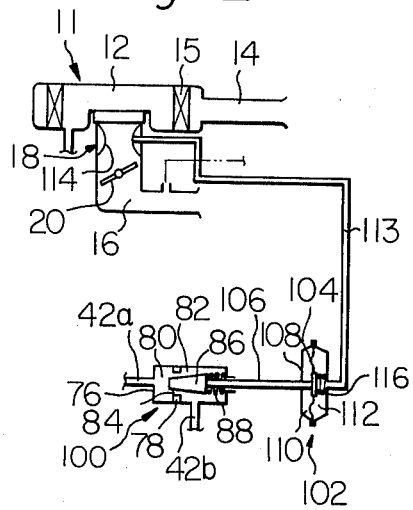

This and other objects and advantages of the invention will become more apparent from the following detailed description taken in connection with the accompanying drawings in which:

FIG. 1 is a schematic cross sectional view of a preferred embodiment of a secondary air supply control device according to the invention; and FIG. 2 is a schematic cross sectional view of one part of another preferred embodiment of a secondary air supply control device according to the invention.

Referring now to FIG. 1, there is shown an internal combustion engine 10 which is provided with an intake system 11 including an air cleaner 12 vented to the outside atmosphere by way of an air inlet or air horn 14 and having a cleaning element or filter 15, an intake conduit 16 leading from the air cleaner 12 to a combustion chamber (not shown) of the engine 10, and a carburettor 18 through which the intake conduit 16 passes and which has a throttle valve 20 rotatably mounted therein, an exhaust system 22, and an exhaust gas purifying system 24 incorporated into the exhaust system 22 to form a part thereof. A secondary air supply control device according to the present invention generally designated by the reference numeral 28 is shown interposed between the intake system 11 and the exhaust gas purifying system 24. The secondary air supply control device 28 comprises a secondary air supply pump 30 which supplies air under pressure to the exhaust gas purifying system 24 and is driven by the engine 10 through pulleys 32 and a belt 34. The pump 30 draws air from the air cleaner 12 by way of a conduit 36 communicating with an inlet port 37 of the pump and pumps air under pressure to the exhaust gas purifying system 24 by way of a conduit 40 communicating with an outlet or discharge port 38 of the pump and a conduit 42. A relief or pressure regulating valve 44 is interposed between the conduit 36 and the conduits 40 and 42 to annul the influence of engine speed exerted on the pressure of air delivered from the pump 30 into the conduit 40. The regulator valve 44 has a housing 46 and a flexible diaphragm member 48 dividing the interior of the housing 46 into a pressure chamber 50 and a closed chamber 52. The diaphragm 48 is deformable in response to the pressure differential between the pressure and closed chambers 50 and 52. The pressure chamber 50 communicates with the conduits 40 and 42 by way of a conduit 54. The housing 46 has a valve seat 56 which is formed in the pressure chamber 50 and is formed therethrough with an exhaust or drain port 58 opening into the pressure chamber 50 and communicating with the conduit 36 by way of a conduit 60. A valve member 62 is fixedly mounted on the diaphragm 48 and is seatable on the valve seat 56 to close the drain port 58. Biasing means 64 such as a helical coil compression spring is disposed in the closed chamber 52 to urge the diaphragm 48 and accordingly the valve member 62 in a direction to close the valve seat 56 in opposition to the pressure differential between the chambers 50 and 52. When the pressure of air in the pressure chamber 50 is less than a predetermined constant value, the valve member 62 is urged by the biasing means 64 to a seated position on the valve seat 56 to close the drain port 58. When the pressure of air in the pressure chamber 50 exceeds the predetermined value, the valve member 62 is unseated from the valve seat 56 to open the drain port 58, the pressure differential between the chambers 50 and 52 overcoming the force of the biasing means 64 so that excessive air in the pressure chamber 50 is exhausted through the drain port 58 into the conduit 60. In this manner, the pressure of secondary air which has been delivered from the pump 30 into the conduit 40 is regulated or maintained at a predetermined constant value independently of engine speed and accordingly the rotational speed of the pump 30.

The closed chamber 52 communicates with the intake conduit 16 at a location downstream from the throttle valve 20 by way of an inlet port 65 formed through the housing 46 and a conduit 66. An a control valve 68 is disposed in the conduit 66 to normally obstruct the communication between the intake conduit 16 and the chamber 52 and provide communication between the atmosphere and the chamber 52. The valve 68 is connected to control means 70 such as an electric solenoid actuator for control thereby and is operated by energization of the control means 70 to open the conduit 66. The control means 70 is electrically connected to sensing means 72 which senses an abnormal condition of exhaust gas such as the temperature thereof higher than a predetermined value and produces an electric signal which is transmitted to the control means 70 to energize the same. When an abnormal condition of exhaust gas occurs, it is sensed by the sensing means 72 to cause the valve 68 to obstruct communication between the atmosphere and the chamber 52 and to provide communication between the intake conduit 16 and the chamber 52 to introduce the vacuum in the intake conduit 16 downstream of the throttle valve 20 into the closed chamber 52. As a result, the diaphragm 48 and accordingly the valve member 62 is moved in the direction to open the drain port 58 by the pressure differential between the chambers 50 and 52 against the force of the biasing means 64, so that supply of secondary air to the exhaust system 22 is reduced or substantially stopped. The sensing means 72 may be a temperature sensor which senses the temperature of exhaust gas higher than a predetermined value and produces an electric signal for energization of the control means 70.

A flow control valve 74 is disposed in the conduit 42 to control or meter the flow of secondary air passing therethrough to the exhaust gas purifying system 24. The flow control valve 74 includes a casing 76 which is formed therein with a partition member 78 dividing the interior of the casing 76 into a first chamber 80 communicating with a conduit 42*a* and a second chamber 82 communicating with a conduit 42*b*. The partition member 78 is formed therethrough with an aperture 84 interconnecting the first and second chambers 80 and 82. A valve member 86 having a truncated cone shape extends from the second chamber 82 through the aperture 84 in the partition member 78 and is movable to continuously vary the effective cross sectional area of the aperture 84 or an annular clearance between the partition member 78 and the valve member 86. Biasing means 88 such as a helical coil compression spring is disposed in the second chamber 82 to urge the valve member 86 in the direction to reduce the effective cross sectional area of the aperture 84. A valve stem 90 fixedly attached to the valve member 86 passes through the casing 76 from the second chamber 82 and is operatively connected to the throttle valve 20 by means of a linkage mechanism including a link lever 92, a link rod 94 and a link lever 96. The valve member 86 is operated by the throttle valve 20 to increase or reduce the effective cross sectional area of the aperture 84 to increase or reduce the flow of secondary air passing to the exhaust system 22 through the conduit 42 when the throttle valve 20 is moved in an opened or crosed direction to increase or reduce, respectively, the flow of intake air passing to the engine combustion chamber through the intake conduit 16. Thus, the flow control valve 74 can control or meter the flow of secondary air supplied to the exhaust system 22 to a desired appropriate ratio with respect to the air drawn into the engine combustion chambers.

A check valve 98 is operably disposed in the conduit 42 at a location downstream from the flow control valve 74 to open the conduit 42 to permit air flow from the conduit 42*b* to conduit 42*c* when the pressure in the conduit 42*b* exceeds the pressure in the conduit 42*c* but to obstruct the conduit 42 to inhibit air flow from the conduit 42*c* to conduit 42*b* when the pressure in the conduit 42*c* exceeds the pressure in the conduit 42*b*.

Referring to FIG. 2, there is shown one part of another preferred embodiment of a secondary air supply control device according to the invention which differs from the secondary air supply control device shown in FIG. 1 in that a flow control valve 100 is controlled by a diaphragm unit 102 operated by carburettor venturi vacuum. Thus, in FIG. 2, the other part of the secondary air supply control device which is identical with the corresponding part of the device of FIG. 1 is omitted. Furthermore, like component elements are designated by the same reference numerals as those used in FIG. 1. The diaphragm unit 102 has a diaphragm 104 operatively connected with a valve stem 106 of the flow control valve 100 and a casing 108 the interior of which is divided by the diaphragm 104 into an atmospheric chamber 110 vented to the atmosphere and a vacuum chamber 112 communicating by way of a conduit 113 with a venturi section 114 formed in an intake passageway 16 in a carburettor 18. Biasing means 116 such as a compression spring is disposed in the vacuum chamber 112 to urge the diaphragm 104 toward the atmospheric chamber 110. A valve menber 86 is operated by the diaphragm 104 to vary the effective cross sectional area of an aperture 84 with respect to the vacuum in the venturi section 114 and accordingly the flow rate of the air taken into the engine combustion chamber, similarly to the valve member 86 of the device of FIG. 1 as described hereinbefore.

It will be appreciated that the amount of secondary air supplied into engine exhaust gases can be controlled to a predetermined ratio with respect to the amount of intake air drawn into the engine, by providing a pressure regulating valve which regulates the pressure of secondary air discharged from a pump to a predetermined constant value irrespective of the engine speed or the rotational speed of the pump, and by providing a flow control valve which then meters the flow of secondary air to a predetermined value with respect to the flow of intake air drawn into the engine. As a result, an exhaust gas cleaning system employing a secondary air supply control device according to the invention can efficiently render harmful constituents in engine exhaust gases harmless.

It will be also appreciated that a secondary air supply control device according to the invention has an advantage in that an optimum amount of secondary air can be supplied into engine exhaust gases even if the device includes a pump having a somewhat excessive capacity to compensate for flow volume reduction resulting from deterioration of the pump. Since the device includes a pressure regulating valve maintaining the pressure of secondary air discharged from the pump at a constant value, the selection of the pump can be easily made.

What is claimed is:

1. A secondary air supply control device for supplying secondary air into exhaust gases discharged from an internal combustion engine, comprising first passage means, an air pump communicating with said first passage means and discharging secondary air under pressure thereinto, a pressure regulating valve operating means having a first chamber which communicates with said first passage means and is formed with a drain port providing communication between said first chamber and the atmosphere, said pressure regulating valve being disposed in said first chamber and being movably located with respect to said drain port, a second chamber communicating with the atmosphere, a flexible diaphragm separating said first and second chambers from each other and operatively connected to said pressure regulating valve, and biasing means urging said diaphragm in a direction opposed by the pressure of secondary air in said first chamber, said pressure regulating valve being operated by said diaphragm to vary the degree of communication between said first chamber and the atmosphere in accordance with the difference between the pressure of secondary air in said first chamber and the atmospheric pressure in said second chamber and regulating the pressure of secondary air in said first passage means to a predetermined value, second passage means communicating with said first passage means, and a flow control valve disposed in said second passage means, and said flow control valve controlling the flow rate of said secondary air passing through said second passage means into the exhaust gases in accordance with the flow rate of intake air drawn into said internal combustion engine.

2. A secondary air supply control device as claimed in claim 1, in which said flow control valve comprises a valve member operatively connected to a throttle valve of said engine and operable to increase and reduce the flow of said secondary air in accordance with movements of said throttle valve in open direction and in closed direction, respectively.

3. A secondary air supply control device as claimed in claim 1, in which said flow control valve comprises a valve member and a diaphragm unit having a diaphragm operatively connected with said valve member and a casing the interior of which is divided by said diaphragm into an atmospheric chamber and a vacuum chamber communicating with a venturi section formed in an intake, conduit of said engine, said valve member being operated by said diaphragm to vary the flow of said secondary air in accordance with a vacuum in said venturi section.

4. A secondary air supply control device as claimed in claim 1, in which said flow control valve comprises a housing the interior of which communicates with said passage means, a partition member located in said interior of said housing and formed therethrough with an aperture, a valve member of a truncated cone shape extending through said aperture, said aperture providing an annular clearance between said partition member and said valve member to form a flow path for said secondary air, said valve member being responsive to increases and decreases in the flow rate of intake air drawn into said engine to be movable to increase and reduce said annular clearance, respectively.

5. A secondary air supply control device as claimed in claim 4, in which said valve member of said flow control valve is responsive to movements of a throttle valve of said engine in output increasing and reducing directions.

6. A secondary air supply control device as claimed in claim 4, in which said valve member of said flow control valve is responsive to increases and decreases in a vacuum in a venturi formed in an induction passage of said engine.

7. A secondary air supply control device as claimed in claim 1, further comprising means adapted to alternatively communicate said second chamber with a vacuum source and with the atmosphere, a control valve disposed between said second chamber and said vacuum source and normally providing communication between said second chamber and the atmosphere and obstructing communication between said second chamber and said vacuum source, and control means responsive to an abnormal condition of exhaust gases of said engine to operate said control valve to obstruct communication between said second chamber and the atmosphere and to provide communication between said second chamber and said vacuum source to admit a vacuum therefrom into said second chamber to cause said pressure regulating valve to open said drain port.

8. A secondary air supply control device for supplying secondary air into exhaust gases discharged from an internal combustion engine, comprising first passage means, an air pump communicating with said first passage means and discharging secondary air under pressure thereinto, a pressure regulating valve disposed in said first passage means and operable in response to the difference between the pressure of said secondary air in said passage means and the atmospheric pressure and regulating the pressure of said secondary air in said first passage means to a predetermined value, second passage means communicating with said first passage means, and a flow control valve disposed in said second passage means, and said flow control valve controlling the flow rate of said secondary air passing through said second passage means into the exhaust gases in accordance with the flow rate of intake air drawn into said internal combustion engine, in which said pressure regulating valve comprises means defining a drain port communicating with an outlet port of said pump which outlet port discharges said secondary air under pressure and a valve member operable to open said drain port in response to a pressure of said secondary air above a predetermined value and to close said drain port in response to a pressure of said secondary air below said predetermined value, in which said valve member of said pressure regulating valve is operatively connected to a flexible diaphragm member deformable in response to the pressure of said secondary air discharged from said pump, said diaphragm member operating said valve member to open and close said drain port in response to a pressure of said secondary air above and below a predetermined value, respectively, in which said diaphragm member is further responsive to a vacuum in an intake conduit downstream of a throttle valve of said engine to operate said valve member to open said drain port only when engine exhaust gases are in an abnormal condition.

9. A secondary air supply control device for supplying secondary air into exhaust gases discharged from an internal combustion engine, comprising first passage means, an air pump communicating with said passage means and discharging secondary air under pressure thereinto, a pressure regulating valve disposed in said passage means and regulating the pressure of said secondary air in said passage means to a predetermined value, second passage means communicating with said first passage means, and a flow control valve disposed in said second passage means, and said flow control valve controlling the flow rate of said secondary air passing through said second passage means into the exhaust gases in accordance with the flow rate of intake air drawn into said internal combustion engine, in which said pressure regulating valve comprises a housing the interior of which communicates with said first passage means and which is formed therethrough with a drain port opening into said inteior of said housing, a valve member located in said interior of said housing and responsive to the pressure of said secondary air in said first passage means and operable to control said drain port, said valve member opening and closing said drain port in response to a pressure of said secondary air in said first passage means above and below said predetermined value, respectively, in which said pressure regulating valve further comprises a flexible diaphragm deformable in response to the pressure of said secondary air in said first passage means and to which said valve member is fixedly secured, said diaphragm dividing said interior of said housing into a first chamber communicating with said first passage means and into which said drain port opens and a second chamber, and biasing means urging said diaphragm in a direction opposed by the pressure of said secondary air in said first chamber, and in which said housing is formed therethrough with an inlet port which opens into said second chamber and means to deliver through said inlet port a vacuum from an intake manifold of said engine into said second chamber to cause said valve member to open said drain port only when exhaust gases discharged from said engine is at an abnormal temperature.

* * * * *